US006691327B1

(12) United States Patent
Meyer

(10) Patent No.: US 6,691,327 B1
(45) Date of Patent: Feb. 17, 2004

(54) SHOULDER PROTECTIVE DEVICE

(76) Inventor: John Meyer, 117 Mattison Rd., Branchville, NJ (US) 07826

( * ) Notice: Subject to any disclaimer, the term of this patent is extended or adjusted under 35 U.S.C. 154(b) by 84 days.

(21) Appl. No.: 10/076,241

(22) Filed: Feb. 15, 2002

(51) Int. Cl.[7] ..... A41D 13/00

(52) U.S. Cl. ..... 2/459; 2/45; 2/268; 224/264; 602/20; 602/61

(58) Field of Search ..... 2/327, 16, 459, 2/326, 44, 59, 328, 45, 268, 455, 468, 461, 908, 125; 128/878, 876; 602/4, 5, 20, 62, 63; 224/257, 264, 265, 600

(56) References Cited

U.S. PATENT DOCUMENTS 378,394 A * 2/1888 Haskins ..... 2/460
3,504,377 A * 4/1970 Biggs et al. ..... 2/462
4,735,198 A * 4/1988 Sawa ..... 128/878
5,181,906 A * 1/1993 Bauerfeind ..... 602/63
5,188,587 A * 2/1993 McGuire et al. ..... 602/20
6,079,055 A * 6/2000 Mencel ..... 2/459
6,145,134 A * 11/2000 Davis et al. ..... 2/463
6,202,214 B1 * 3/2001 Light ..... 2/45
6,481,022 B1 * 11/2002 D'Adario et al. ..... 2/268

* cited by examiner

*Primary Examiner*—Tejash Patel

(57) ABSTRACT

A shoulder protective device for protecting the shoulder and arm of the user when carrying heavy objects upon one's shoulder. The shoulder protective device includes a band of material being adapted to be worn about a portion of a user's upper torso and about a shoulder of a user; and also includes a sleeve being attached to the band of material; and further includes a protective assembly being attached to the band of material and including an outer layer of material and an inner layer of material; and further includes a plurality of pads being attached to the band of material and the protective assembly for providing comfort for the user wearing the band of material.

3 Claims, 4 Drawing Sheets

SHOULDER PROTECTIVE DEVICE

BACKGROUND OF THE INVENTION

1. Field of the Invention

The present invention relates to shoulder protective garments and more particularly pertains to a new shoulder protective device for protecting the shoulder and arm of the user when carrying heavy objects upon one's shoulder.

2. Description of the Prior Art

The use of shoulder protective garments is known in the prior art. More specifically, shoulder protective garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,894,868; U.S. Pat. No. 3,906,944; U.S. Pat. No. 4,353,133; U.S. Pat. No. 4,050,099; U.S. Pat. No. 3,504,377; and U.S. Pat. No. Des. 377,564.

While these devices fulfill their respective, particular objectives and requirements, the aforementioned patents do not disclose a new shoulder protective device. The prior art describes inventions having padded members and straps supporting the padded members about selected areas of the user's body.

SUMMARY OF THE INVENTION

The general purpose of the present invention, which will be described subsequently in greater detail, is to provide a new shoulder protective device which has many of the advantages of the shoulder protective garments mentioned heretofore and many novel features that result in a new shoulder protective device which is not anticipated, rendered obvious, suggested, or even implied by any of the prior art shoulder protective garments, either alone or in any combination thereof. The present invention includes a band of material being adapted to be worn about a portion of a user's upper torso and about a shoulder of a user; and also includes a sleeve being attached to the band of material; and further includes a protective assembly being attached to the band of material and including an outer layer of material and an inner layer of material; and further includes a plurality of pads being attached to the band of material and the protective assembly for providing comfort for the user wearing the band of material. None of the prior art describes a band of material, a sleeve, and silicone gel for cushioning a user's shoulder upon which heavy objects are to be carried.

There has thus been outlined, rather broadly, the more important features of the shoulder protective device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new shoulder protective device which has many of the advantages of the shoulder protective garments mentioned heretofore and many novel features that result in a new shoulder protective device which is not anticipated, rendered obvious, suggested, or even implied by any of the prior art shoulder protective garments, either alone or in any combination thereof.

Still another object of the present invention is to provide a new shoulder protective device for protecting the shoulder and arm of the user when carrying heavy objects upon one's shoulder.

Still yet another object of the present invention is to provide a new shoulder protective device that is easy and convenient to wear.

Even still another object of the present invention is to provide a new shoulder protective device that prevents injury to a user's shoulder when carrying large and heavy objects thereupon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
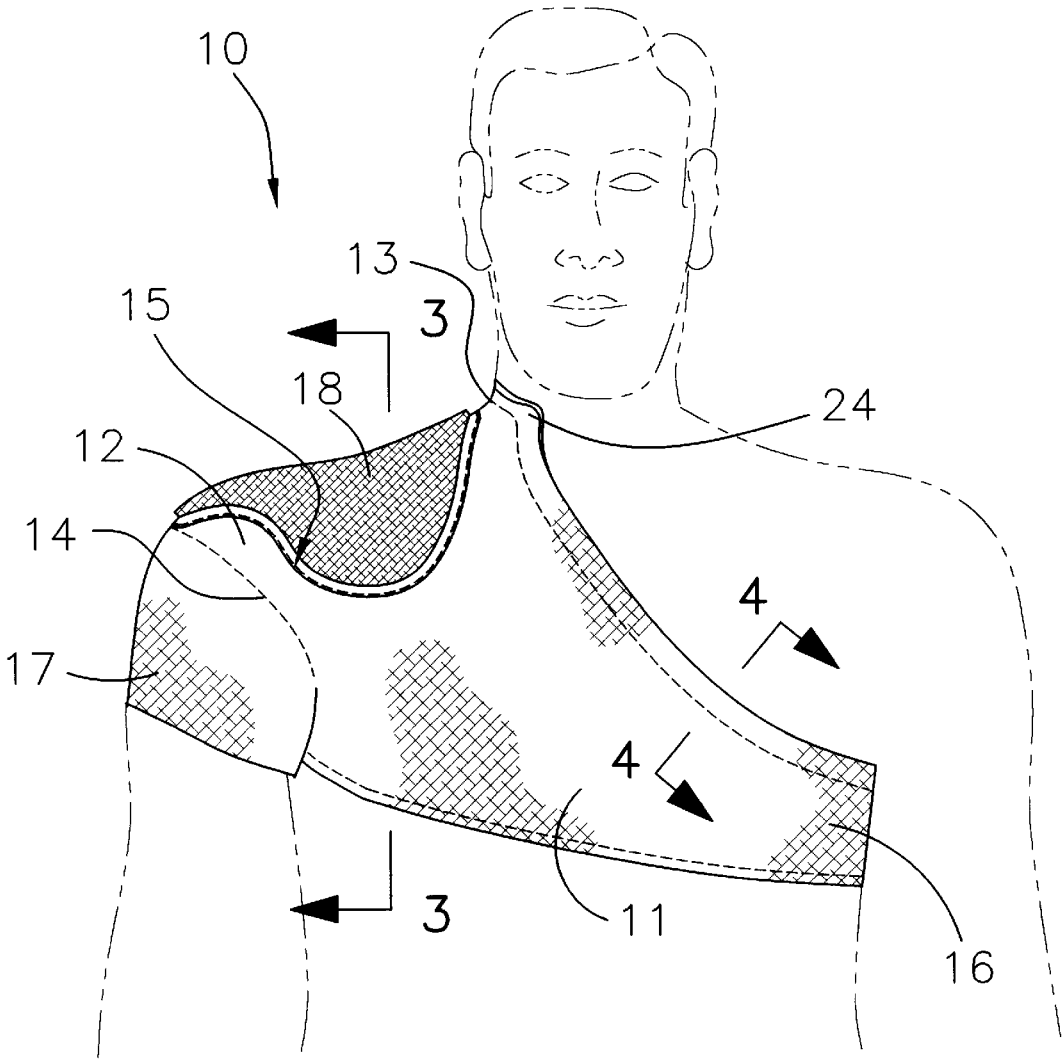
FIG. 1 is a front elevational view of a new shoulder protective device according to the present invention and shown in use.
Figure 2:
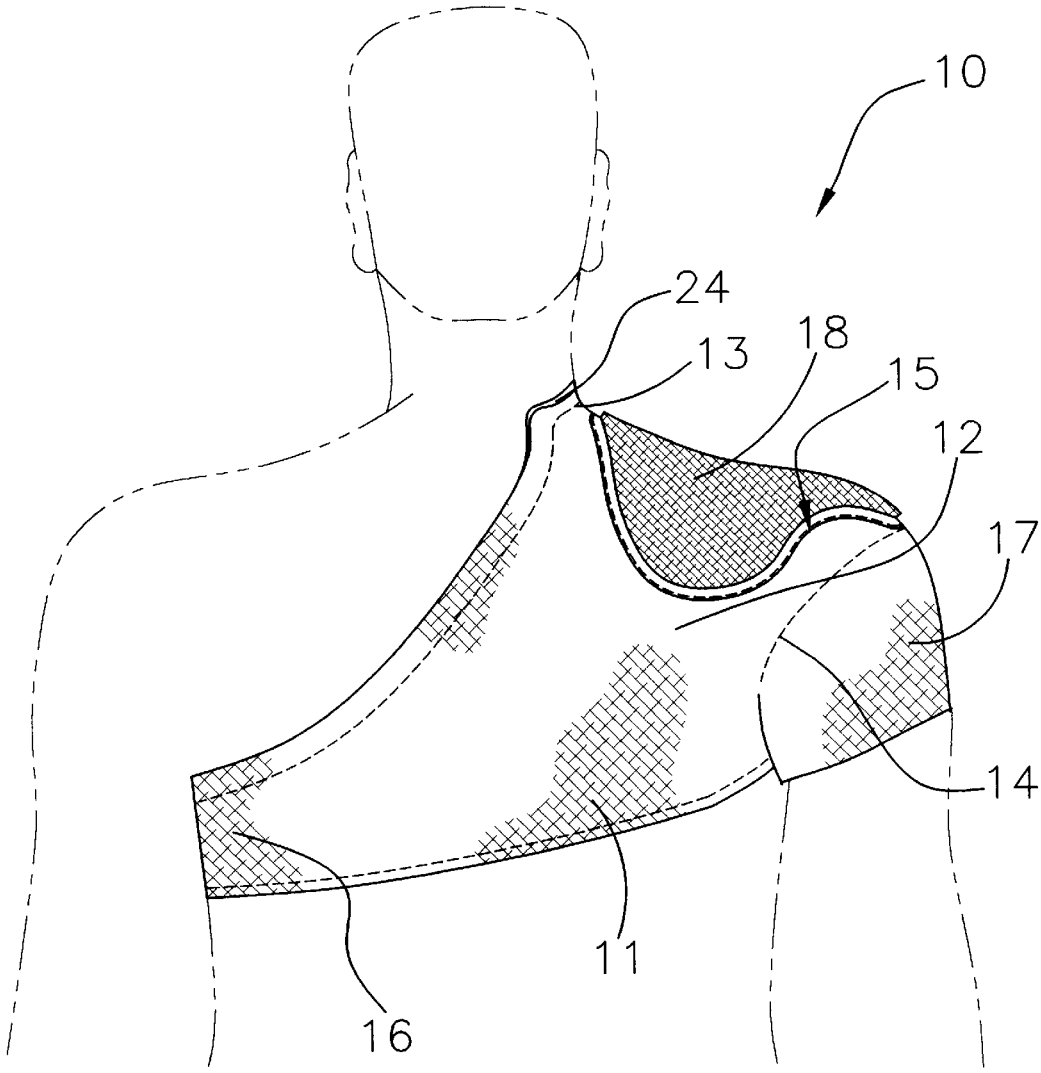
FIG. 2 is a rear elevational view of the present invention.
Figure 3:
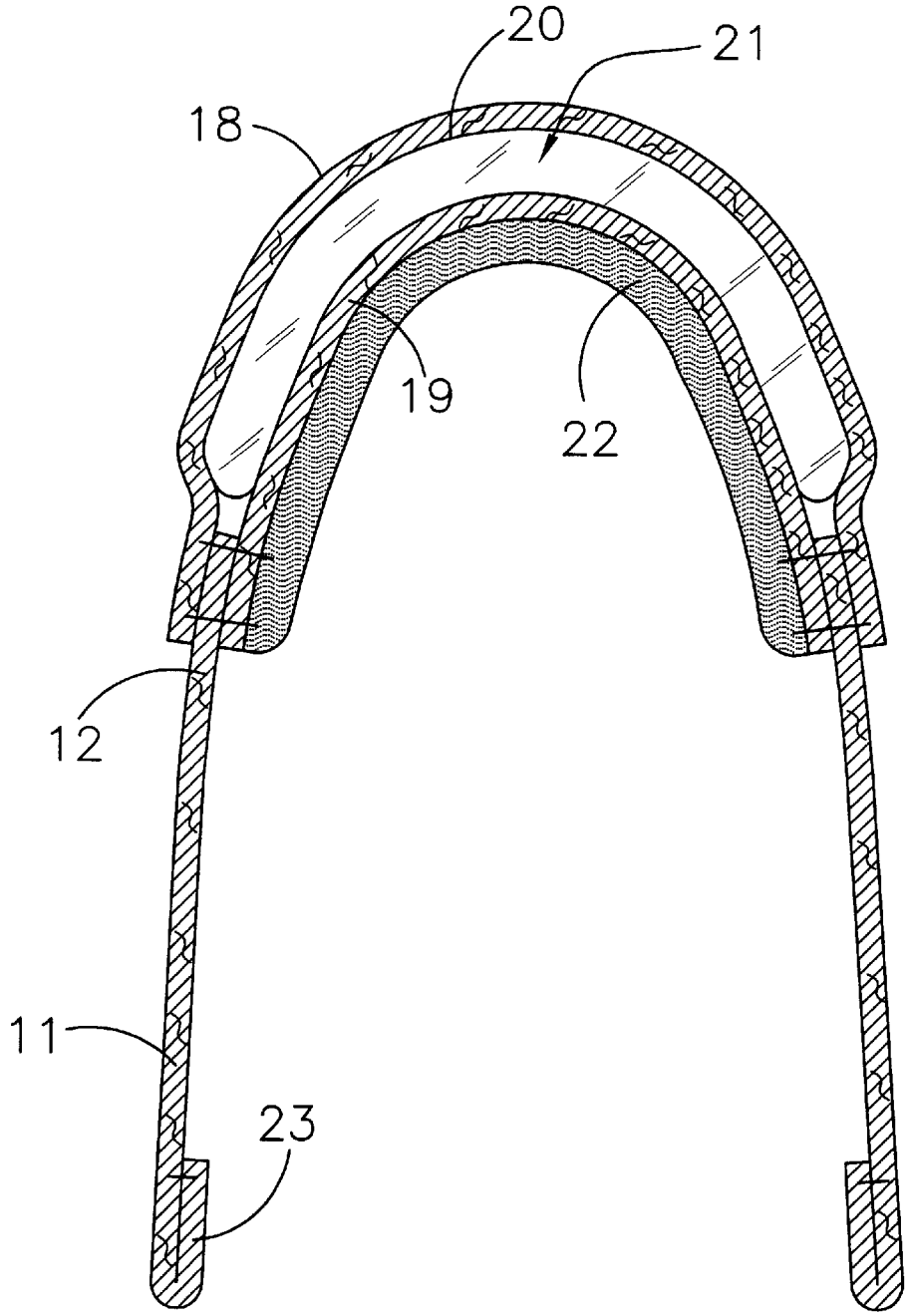
FIG. 3 is a cross-sectional view of a wide portion of the present invention.
Figure 4:
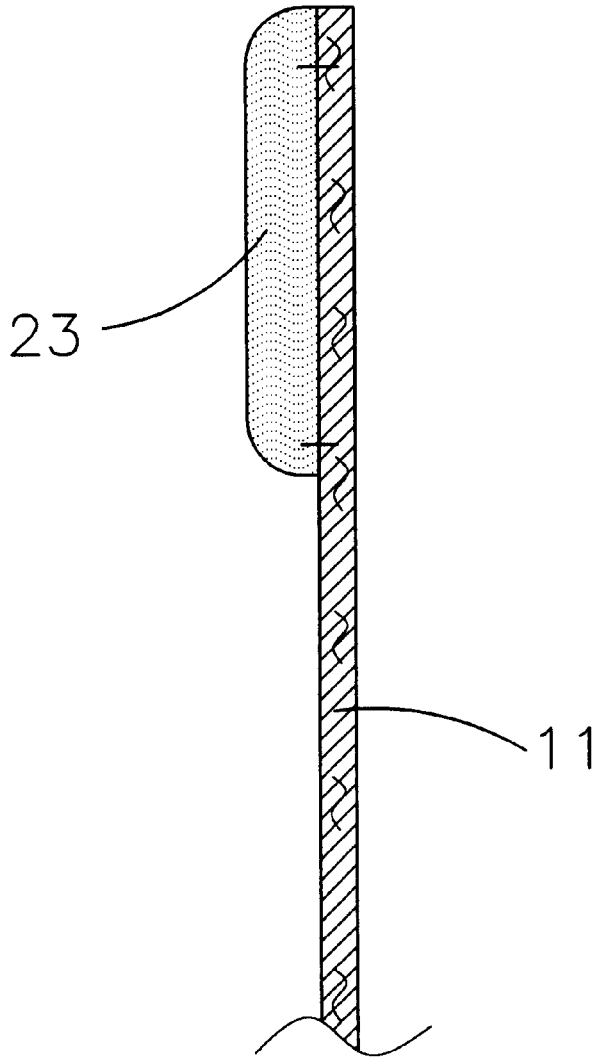
FIG. 4 is a cross-sectional view of a narrow portion of the present invention

With reference now to the drawings, and in particular to FIGS. 1 through 4 thereof, a new shoulder protective device embodying the principles and concepts of the present invention and generally designated by the reference numeral 10 will be described.

As best illustrated in FIGS. 1 through 4, the shoulder protective device 10 generally comprises a stretchable band of material 11 being adapted to be worn about a portion of a user's upper torso and about a shoulder of a user. The band of material 11 also includes a strap portion 16 being adapted to extend about the user's upper torso and beneath one of the user's arms, and further includes a shoulder portion 12 being adapted to extend about the user's shoulder with the shoulder portion 12 being wider than the strap portion 16. The band of material 11 also includes a collar 24 being securely attached to and extending along a neckline edge 13 of the shoulder portion 12 of the band of material 11. The shoulder portion 12 of the band of material 11 has an opening 15 therein which is adapted to be disposed on top of the user's shoulder.

A sleeve 17 is securely attached and sewn to the band of material 11. The sleeve 17 is securely attached along and depending from an arm edge 14 of the shoulder portion 12 of the band of material 11 and is adapted to receive a user's arm therethrough.

A protective assembly is securely and conventionally attached and sewn to the band of material 11 and includes an outer layer of material 18 and an inner layer of material 19. The outer and inner layers of material 18,19 are disposed in the opening 15 of the shoulder portion 12 of the band of material 11 and are securely sewn along the edge forming the opening 15 of the band of material 11. The protective assembly further includes a bag member 20 being sandwiched between the outer and inner layers of material 18,19 and being filled with silicone gel 21 for cushioning the selected user's shoulder.

A plurality of pads 22,23 are securely and conventionally attached to the band of material 11 and to the protective assembly for providing comfort for the user wearing the band of material 11. The pads 22,23 include a padded member 22 being securely and conventionally attached to the inner layer of material 19 for cushioning and comforting the user's shoulder, and also includes padded strips 23 being securely and conventionally attached to an inner side and along edges of the band of material 11 for resting against and comforting the user's body.

In use, the user slips the band of material 11 around one's head with the strap portion 16 being placed under one of the user's arms and the shoulder portion 12 being placed about the shoulder upon which the user intends to carry heavy objects with the user putting the arm attached to that shoulder through the sleeve 17 making sure that the protective assembly is positioned on top of the selected user's shoulder. The user then can place heavy objects upon the protective assembly without hurting one's shoulder since the silicone gel 21 cushions the heavy object against the user's shoulder.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the shoulder protective device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoulder protective device comprising:

a stretchable band of material being adapted to be worn about a portion of a user's upper torso and about a shoulder of a user, said band of material also including a strap portion being adapted to extend about the user's upper torso and beneath one of the user's arms, and further including a shoulder portion being adapted to extend about the user's shoulder, said shoulder portion being wider than said strap portion, said shoulder portion of said band of material having an opening therein, said opening being adapted to be disposed on top of the user's shoulder;

a sleeve being attached to said band of material;

a protective assembly being attached to said band of material and including an outer layer of material and an inner layer of material; and a plurality of pads being attached to said band of material and said protective assembly for providing comfort for the user wearing said band of material.

2. A shoulder protective device as described in claim 1, wherein said outer and inner layers of material are disposed in said opening of said wide portion of said band of material and are securely sewn to said band of material.

3. A shoulder protective device as described in claim 1, wherein said protective assembly further includes a bag member sandwiched between said outer and inner layers of material and being filled with silicone gel for cushioning the selected user's shoulder.

* * * * *